United States Patent [19]

Hirata et al.

[11] Patent Number: 4,743,211

[45] Date of Patent: May 10, 1988

[54] CONNECTING DEVICE FOR IGNITION SYSTEM OF MOTOR VEHICLE

[75] Inventors: Akihiko Hirata, Kohza; Yuji Watanabe, Suzuka, both of Japan

[73] Assignee: Sumitomo Wiring Systems, Yokkaichi, Japan

[21] Appl. No.: 842,989

[22] Filed: Mar. 24, 1986

[30] Foreign Application Priority Data

Mar. 23, 1985 [JP] Japan ..... 60-58692
Mar. 23, 1985 [JP] Japan ..... 60-41787

[51] Int. Cl.[4] ..... H01R 33/74

[52] U.S. Cl. ..... 439/686; 439/125; 439/521; 123/169 PH

[58] Field of Search ..... 339/192 R, 192 RL, 223 S, 339/209, 116 C, 27, 26, 147 C, 147 P, 206 R, 206 P, 143 S; 174/92, 50, 52 R, 59; 123/69 PH, 148 P; 313/134, 137

[56] References Cited

U.S. PATENT DOCUMENTS

| | | | |
|---|---|---|---|
| 1,569,101 | 1/1926 | Vaughn . | |
| 1,570,722 | 1/1926 | Baldwin | 123/169 PH |
| 2,149,027 | 2/1939 | Meredith | 123/169 PH |
| 2,224,057 | 12/1940 | MeJean | 339/192 R |
| 2,677,855 | 5/1954 | Mallory | 339/223 S |
| 2,686,510 | 8/1954 | Platner | 123/169 PH |
| 3,206,539 | 9/1965 | Kelly | 174/92 |
| 3,965,879 | 6/1976 | Fitzner | 123/148 P |

OTHER PUBLICATIONS

Automotive Handbook—Ignition pp. 376–377.

*Primary Examiner*—Gil Weidenfeld
*Assistant Examiner*—Thomas M. Kline
*Attorney, Agent, or Firm*—Cushman, Darby & Cushman

[57] ABSTRACT

A connecting device for ignition cables and a component in motor vehicle ignition system having a plurality of ignition cables with a L-shape hood of elastic materials which is attached to each of the cable terminals, housing of connecting device with hood supporting member for holding the hood in a mating alignment to outside terminals, and a locking member in the housing.

2 Claims, 4 Drawing Sheets

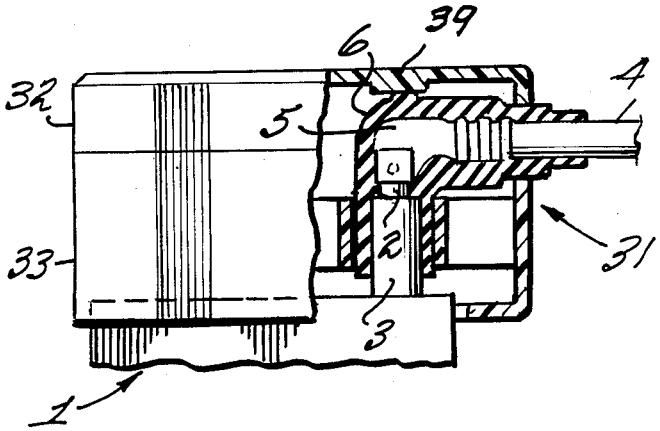
FIG. 8
FIG. 9
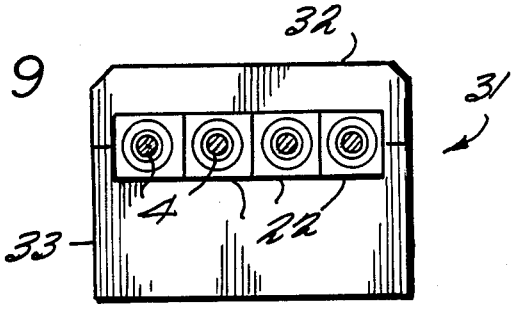
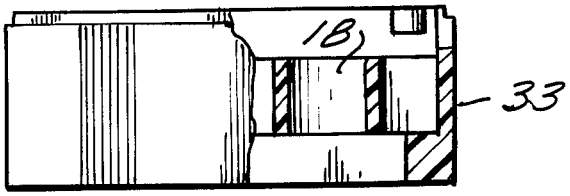
FIG. 10
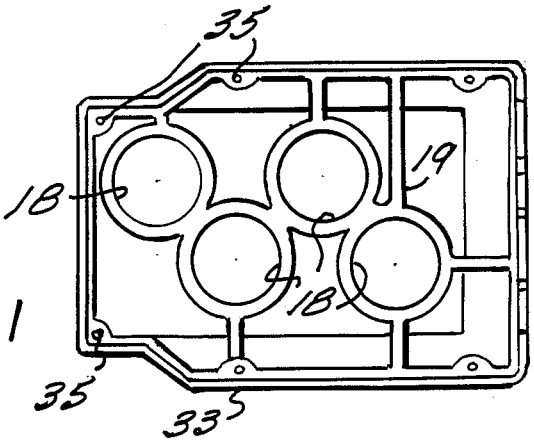
FIG. 11
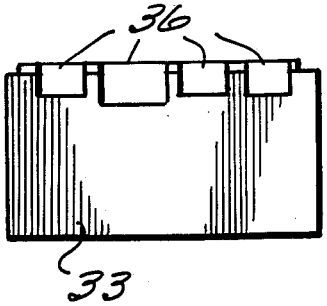
FIG. 12

CONNECTING DEVICE FOR IGNITION SYSTEM OF MOTOR VEHICLE

BACKGROUND OF THE INVENTION

The present invention relates to an improved connecting device for coupling ignition cables to ignition apparatus such as ignition coil, spark plug, output terminal for high voltage diode circuitry, or distributor terminal, mainly for use in a motor vehicle.

DESCRIPTION OF THE PRIOR ART

Most vehicles are equipped with a conventional coil (inductive) ignition system. Ignition cable is used for connecting such components in system as ignition coil, spark plug, ignition distributor (distributor) as described at pages 376–377 of "Automotive Handbook", 1st English Ed. issued by Robert Bosch GMBH, Germany.

In practice ignition cable is used for connecting terminals of spark plugs, which are installed in a protruding portion of an automotive engine, with nipples of a distributor. In many cases an L-shaped rubber cap is attached to one connecting end of an ignition cable with the nipple of the distributor in order to lead the ignition cable in a rectangular (horizontal) direction from its longitudial (vertical) axis. The use of such an L-shaped terminal structure makes the connecting operation more difficult as the number of terminals increases because the working space of an engine compartment of a motor vehicle is limited. If the terminal structure leads all wires in the same direction, for instance in a vertical direction, a protective covering device such as disclosed in U.S. Pat. No. 1,569,101 is useful for preventing water from entering and avoiding excessive heating of the inside atmosphere of the device and eliminating condensation of water vapor.

U.S. Pat. No. 1,569,101 does not teach a device for connecting L-shaped terminators with ignition apparatus. The principal object of the present invention is to provide an improved connecting device especially useful for making connection with ignition apparatus of motor vehicle which enables the coupling of each of the components in ignition system with ignition cables having an L-shaped terminal structure on each of their cable end by merely applying the bottom surface of connecting device to an area of ignition apparatus including protruding terminal portions.

SUMMARY OF THE INVENTION

The present invention is directed to a connecting device for ignition cables with ignition apparatus of motor vehicles, such as ignition coil, spark plug or distributor.

On one end of the ignition cable there is attached an electrical terminal having an L-shaped hood made of an elastic material.

The top portion of the elastic hood faces the inner surface of housing of the connecting device. Its bottom portion is supported within a circular frame in a bottom plate of the housing, which is inserted into or screwed to the housing, maintaining openings in the bottom portion for accommodating shapes and placement of electrical terminals which will be determined by an alignment of protruding portions on auto-ignition apparatus. The connecting device composed of housing, bottom plate with at least one circular opening in supporting frameworks, and of a plurality of ignition cables which have been inserted into the housing through its side wall, is fitted with a tower portion of the ignition apparatus and thus connection of ignition cables with terminals on the top of the protruding portions of the ignition apparatus by one-piece-operation is achieved.

BRIEF DESCRIPTION OF THE DRAWINGS

FIG. 8 is a cross-sectional front view of the housing of a connecting device according to the present invention.

FIG. 9 is a side view of a housing according to the present invention showing grommets and cable cross sections along Section B—B of FIG. 8.

FIG. 10 is a partial cross-sectional front view of a lower body portion according to the present invention.

FIG. 11 is a plan view of a lower body portion according to the present invention shown Section A—A of FIG. 8.

FIG. 12 is a side view of a lower body portion according to the present invention along Section C—C of FIG. 8.

DETAILED DESCRIPTION OF A PREFERRED EMBODIMENT

Figure 1:
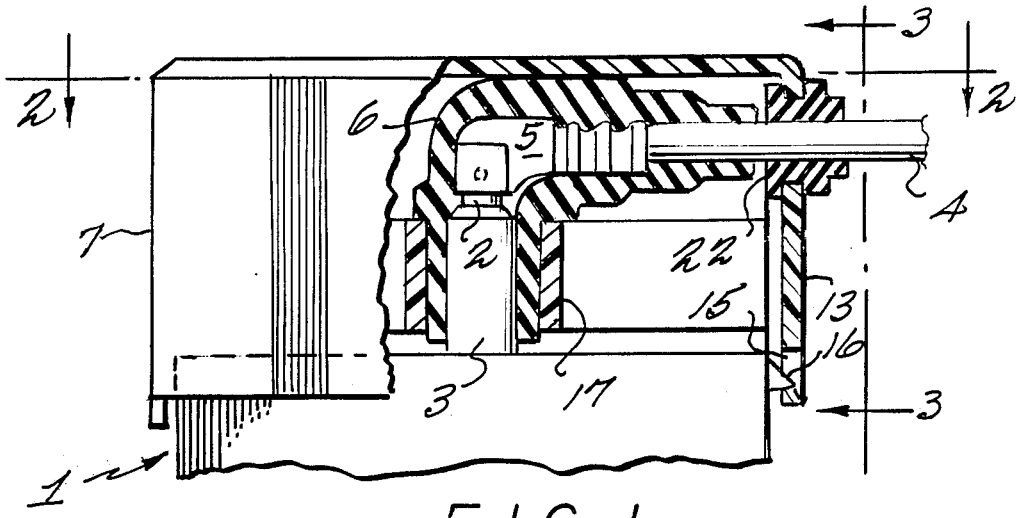
FIG. 1 is a cross-sectional front view of the connecting device of the present invention.
Figure 2:
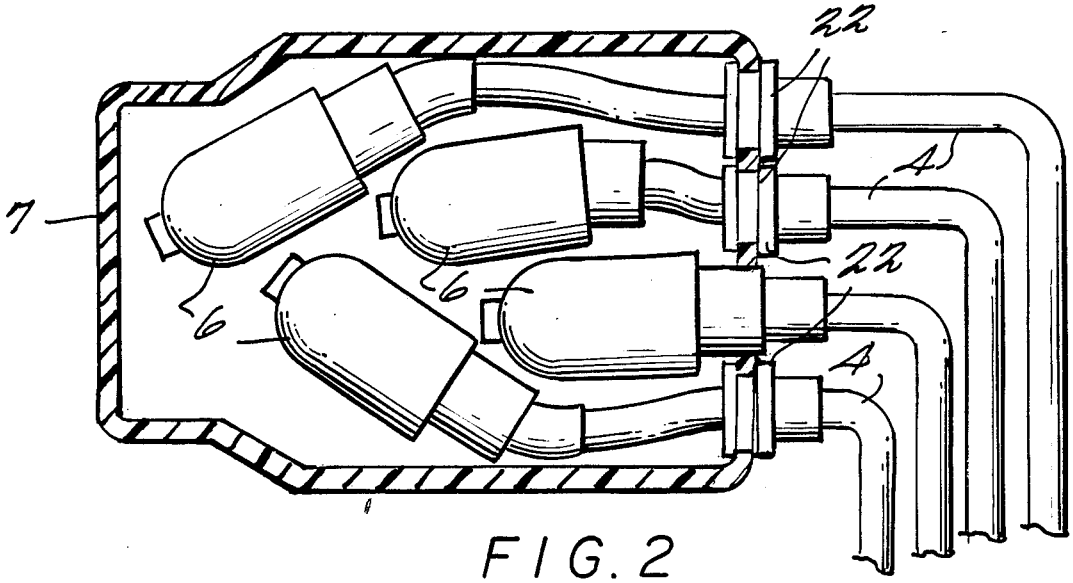
FIG. 2 is an over view taken along the line A—A in FIG. 1 of the connecting device of the present invention.
Figure 3:
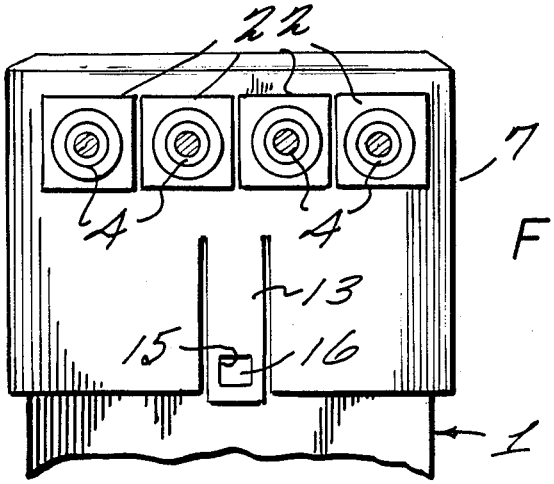
FIG. 3 shows a side view of the connecting device of the present invention illustrating openings on the wall along section B—B of FIG. 1.

FIGS. 1–3 show an ignition apparatus 1 such as an a distributor of a coil ignition system of a four cylinder engine of motor vehicle having a protruding portion 3 with a male terminal 2 on its top portion.

High voltage ignition cable 4 is lead in an almost rectangular (horizontal) direction to the longitudinal axis of the terminal 2 and an elastic L-shaped hood 6 is fitted to the terminal 2 in a way that it covers the contact area of ignition cable 4, the terminal 2 and the protruding portion 3. The elastic hood 6 is made of rubber or other elastic materials.

Housing 7 of the connecting device of the present invention contains four sets of the above described connection means covered by the elastic hood 6 and is pressedly applied to the ignition apparatus 1.

Figure 4:
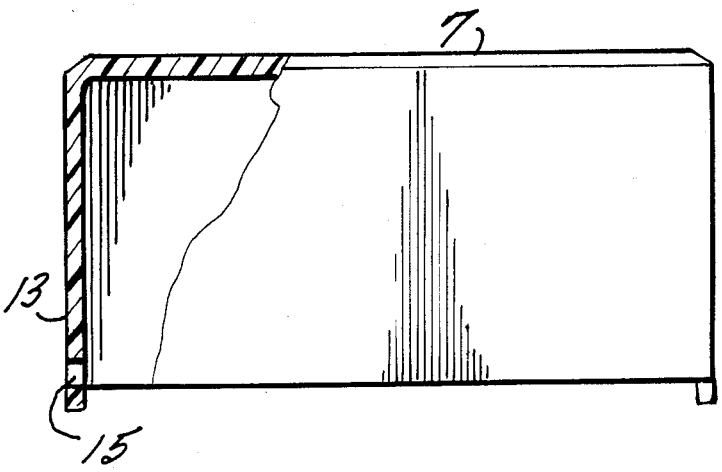
FIG. 4 is a semi cross-sectional front view which illustrates locking support means for the bottom plate.
Figure 5:
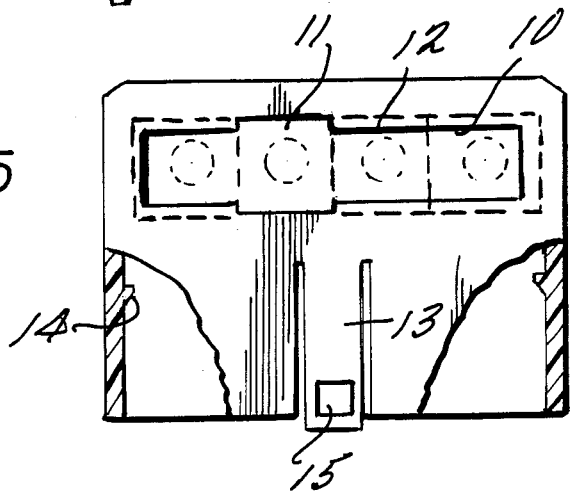
FIG. 5 is a semi cross-sectional side view showing locking means for supporting the bottom plate of the connecting device of the present invention.

In FIGS. 4–5, the housing of connecting device 7 has an elastic arm 13 which is pressedly engaged with lock-protuberance 16 placed on the mating position in ignition apparatus 1 at the lock-receptacle window of the elastic plate 13.

Figure 6:
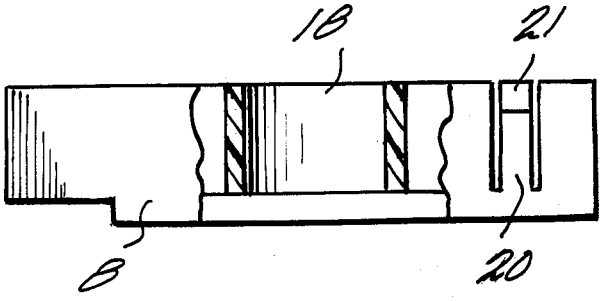
FIG. 6 is a cross-sectional front view of the bottom plate of the connecting device of the present invention.
Figure 7:
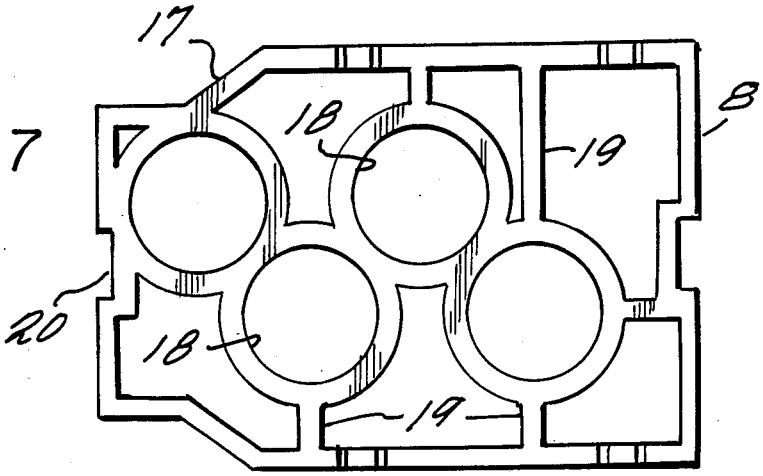
FIG. 7 is an over view of the bottom plate of the connecting device of the present invention illustrating frame-work structure which supports bottom of the L-shaped hood of electrical terminal attached to the ignition cable.
Figure 13:
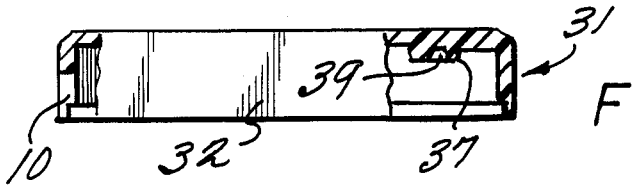
FIG. 13 shows inner wall contact portion which faces the top side of the L-shaped hood.

FIG. 6 illustrates a cross-sectional front view of the bottom plate 8, which engages the lower end portion of the housing of connecting device 7. In FIG. 7 the holding framework 17 of the bottom plate 8 is illustrated. Framework 17 is made up of a series of circular openings 18 and rib members 19. The wall of the circular opening 18 holds outer surface of elastic hood 6 when the bottom plate 8 is inserted into the housing 7 pressing down the elastic arm 13 which passes along a guide groove 20 of the bottom frame until a locking arm 21 reaches the lock protuberance 14.

As illustrated in FIG. 7, circular openings 18 correspond to elastic hoods 6 respectively and their placements are in good accordance so that the connecting device of the present invention is easily applied to ignition apparatus by engaging lock-receptacle window 15 with lock-protuberance 16 by pressing the housing 7 of the connecting device.

FIGS. 5–7 show another locking means consisting of a plurality of rib member 19 and lock protuberance 14. The elastic hood 6 (shown in FIG. 2) is received within holding frame work 17 and rests on the upper portion of it.

The upper portion of the hood is gently supported by the back side surface of the top side of the housing 7 and thus electrical contact within a connecting device of the present invention is kept in a stable condition without electric shortening due to vibration of the engine.

In FIG. 5 an aperture 10 located in the side wall of housing 7 is shown. The aperture 10 consists of a wide portion 11 and narrow portion 12.

As seen in FIG. 2, a grommet 22 (having a mating groove) is attached to each of cables 4. The cables are then introduced in an appropriate order into housing 7 through wide opening 11. The last ignition cable is also introduced into housing 7 through opening 11 where an end portion of the elastic hood 6 is engages with opening 11, instead of utilizing another grommet as in the case of the previously inserted cables.

Although an improved locking means for providing reliable electrical termination of ignition apparatus 1 with ignition cable 4 should be clear from the foregoing description, it should also be noted that engagement of housing 7 with ignition apparatus 1 (FIG. 1) can be visually confirmed when lock-protuberance 16 of the ignition apparatus 1 appears in the lock-receptacle window 15 of housing 7. Thus, a state of semi-locking or other unstable application of the connecting device is avoided.

Another preferred embodiment of the connecting device of the present invention, is illustrated in FIGS. 8–16. Housing 31 is shown comprising a cover portion 32, and a lower body portion 33. In this embodiment, a bottom plate (not shown) is jointly molded with the lower body portion 33 into a single piece such molding can be performed by any known method of molding using synthetic resinous material, either of thermoelastic or thermosetting character.

As in the preceding embodiment a female terminal 5 is attached to the connecting end of an ignition cable 4. The female terminal 5 is then covered by a L-shape hood of elastic materials such as rubber.

The ignition cables are introduced into the housing 31 of the connecting device of the present invention one by one and an open end portion of L-shape hood is placed into a circular opening 18 in a frame structure 17 in a bottom plate 34 (not shown in the drawings) and thus open end portions of the hoods on ignition cable are held in an upright direction, while the other end portions, which are fitted with ignition cables, are extended in an almost rectangular direction leading the cables in a horizontal direction.

An advantage of separating the housing of the connecting device 31 into the lower body portion 33 and cover portion 32 is that all ignition cables to be connected are introduced into the lower body portion and that they are placed in a desired, predetermined alignment without difficulty.

After the above described operation is completed, the cover portion 32 is applied to the lower body portion 33 and both portions are tied together utilizing bolts adapted to holes 35.

Apertures 36 of suitable form are quite effective in order to have ignition cables 4 be laid on the mating side walls of the lower body portion 33 and the cover portion 32 through preferrably grommets of cushioning elastic materials such as rubber, achieving to prevent the housing 31 from entrance of water.

Figure 14:
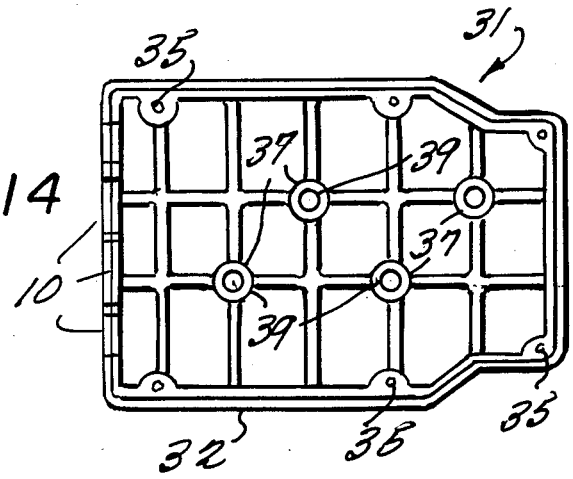
FIG. 14 shows an alignment of circular contact portion located in the back side surface of the covering portion of the connecting device.
Figure 15:
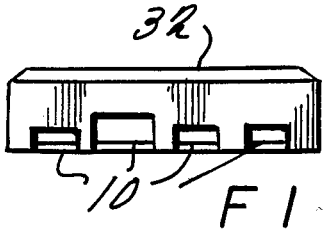
FIG. 15 is a side view of the covering portion of the connecting device of the present invention showing openings for cable insertion with grommet covering the frame of the openings along Section C—C of FIG. 8.
Figure 16:
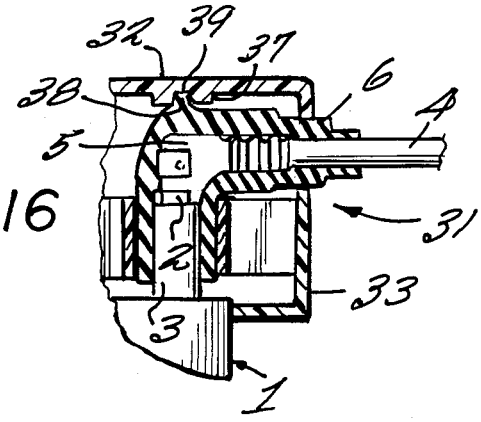
FIG. 16 is a cross-sectional front view of the connecting device illustrating a state of holding cable end portion within the connecting device of the present invention.

FIGS. 14–16 reveal further advantageous features of a connecting device according to the present invention.

As shown in FIG. 16, the L-shaped elastic hood 6, covering the female terminal 5 of ignition cable 4, is placed in lower body portion 33 within a circular opening 18 (not labelled in these figures) and is held within holding framework 17. The top portion of the L-shaped elastic hood 6 faces the back side of the cover portion 32 so that the hood 6 is kept in an upright position.

FIG. 16 shows another example of setting the elastic hood 4 into the housing 4. A protuberance of the elastic hood 38 is received within a receptacle 39 which is located in the protuberance 37 on the backside surface of the cover portion 32 of the housing 4.

As described in details the connecting device of the present invention contemplates to provide an improved ignition system of motor vehicle with reliable electrical connections between components which is unaffected by vibration of engine and is free from water entrance.

According to the characteristic features of the connecting device of the present invention, reliable electrical connection between components of ignition system for motor vehicle is achieved. By utilizing supporting means for L-shape elastic hood of electrical terminals together with a locking system inside the housing of the connecting device, the connection which is substantially free from short circuit or brake due to entrance of water, and to vibration of engine is provided.

While in the foregoing, there has been provided a detailed description of particular embodiments of the present invention, it is to be understood that all equivalents obvious of those having skill in the art are to be included within the scope of the invention as claimed.

We claim:

1. An electrical conductor housing device for an ignition apparatus of a motor vehicle with ignition cables, said device comprising:

an electrically non-conductive inverted cup-shaped first housing member with a number of openings in a side wall thereof through which a number of ignition cable end portions extend;

said ignition cable end portions having at least one electric terminal attached thereto, each ignition cable end portion being covered by an L-shaped hood member of elastic material having a first end and a second end; and an electrically non-conductive second housing member comprising a plate having upper and lower surfaces with a plurality of circular openings therein, each circular opening having an upwardly protruding cylindrical frame member associated therewith, said second housing member engaging said first housing member such that each of said frame members surroundingly engages a second end of said L-shaped hood members, thereby orienting each of said second ends of said L-shaped hood members in a downward direction with respect to the inside of said first housing member.

2. An electrical connector housing device as in claim 1, further comprising;

said ignition apparatus having an upper surface with a number of electrically conductive upwardly extending protrusions located thereon, said ignition apparatus engaging said first and second housing members such that each protrusion extends into a second end of said L-shaped hood members and engages the electric terminal associated therewith.

* * * * *